US009920603B2

(12) United States Patent
Bogachuk et al.

(10) Patent No.: US 9,920,603 B2
(45) Date of Patent: Mar. 20, 2018

(54) METHOD OF OPERATING A WELL USING A PUMP ASSEMBLY WITH A VARIABLE-FREQUENCY DRIVE

(71) Applicant: Jury F. Bogachuk, Tjumen (RU)

(72) Inventors: Jury F. Bogachuk, Tjumen (RU); Nikolay V. Buchelnikov, Tjumen (RU)

( * ) Notice: Subject to any disclaimer, the term of this patent is extended or adjusted under 35 U.S.C. 154(b) by 17 days.

(21) Appl. No.: 14/886,002

(22) Filed: Oct. 17, 2015

(65) Prior Publication Data

US 2016/0032698 A1 Feb. 4, 2016

Related U.S. Application Data

(63) Continuation of application No. PCT/RU2013/001022, filed on Nov. 15, 2013.

(30) Foreign Application Priority Data

Apr. 22, 2013 (RU) ..... 2013118458

(51) Int. Cl.
*E21B 43/12* (2006.01)
*F04B 47/06* (2006.01)
*E21B 43/00* (2006.01)

(52) U.S. Cl.
CPC ..... *E21B 43/128* (2013.01); *E21B 43/00* (2013.01); *F04B 47/06* (2013.01)

(58) Field of Classification Search
CPC .. E21B 33/1291; E21B 33/128; E21B 34/063; E21B 43/26
See application file for complete search history.

(56) References Cited

U.S. PATENT DOCUMENTS 5,820,350 A * 10/1998 Mantey ..... E21B 43/126 417/44.1
5,844,397 A 12/1998 Konecny et al.
(Continued)

FOREIGN PATENT DOCUMENTS

CA 2729534 A1 * 7/2012 ..... E21B 43/126
EA 11044 B1 12/2008
(Continued)

OTHER PUBLICATIONS

International Search Report from International Application No. PCT/RU2013/001022, filed Nov. 15, 2013, dated Apr. 24, 2014.

*Primary Examiner* — Giovanna C. Wright
*Assistant Examiner* — Brandon M. Duck
(74) *Attorney, Agent, or Firm* — John Alumit

(57) ABSTRACT

The method and device of exploitation of well by pumping unit with variable-frequency drive involves periodic repetition of the cycles including pumpdown, search for frequency when delivery stops and accumulation and at the same time to ensure such extraction of fluid from well which is equal to its inflow it is necessary to choose unit with higher capacity in comparison with inflow of fluid from formation into well and during the cycles the pumpdown-accumulation ratio is corrected depending on the results of the previous cycles until the pumpdown-accumulation time ratio stops to change and the torque at which the delivery stops is determined based on the equality of the current torque of the downhole motor shaft and check torque which is predetermined based on stepwise drop of torque of the downhole motor shaft in the point when delivery stops when supply voltage is decreased.

1 Claim, 3 Drawing Sheets

(56) References Cited

U.S. PATENT DOCUMENTS

| | | | | |
|---|---|---|---|---|
| 6,043,995 | A | 3/2000 | Leuthen | |
| 6,481,973 | B1 | 11/2002 | Struthers | |
| 2008/0247880 | A1 | 10/2008 | Leuthen et al. | |
| 2011/0284218 | A1* | 11/2011 | Chudnovsky | E21B 43/003 166/250.15 |

FOREIGN PATENT DOCUMENTS

| | | | | |
|---|---|---|---|---|
| RU | 7455 | U1 | 8/1998 | |
| RU | 2119578 | C1 * | 9/1998 | E21B 43/00 |
| RU | 2181829 | C2 | 4/2002 | |
| RU | 2250357 | C2 | 4/2005 | |
| RU | 2293176 | C1 | 2/2007 | |
| RU | 2322571 | C1 | 4/2008 | |
| RU | 2421605 | C1 | 6/2011 | |
| RU | 2426867 | C1 | 8/2011 | |
| RU | 2010146609 | A | 5/2012 | |
| WO | 1994014233 | A1 | 6/1994 | |

* cited by examiner

METHOD OF OPERATING A WELL USING A PUMP ASSEMBLY WITH A VARIABLE-FREQUENCY DRIVE

RELATED APPLICATIONS

This Application is a Continuation application of International Application PCT/RU2013/001022, filed on Nov. 15, 2013, which in turn claims priority to Russian Patent Applications RU2013118458, filed Apr. 22, 2013, both of which are incorporated herein by reference in their entirety.

FIELD OF THE INVENTION

The invention pertains to the oil production and can be used in wells equipped with electric pumps namely electric submersible pumps.

BACKGROUND OF THE INVENTION

A method of operating a well using an electric pump with a variable frequency drive (as disclosed in Russian patent no. RF 2426867) is known. That method is based on continuously operating the pump, and includes starting the pump with a defined process rate, changing the supply voltage frequency when the pump reaches a defined frequency in a stationary mode, with acceleration in case of a pump-off condition, and providing a supply of liquid by pump in the stationary mode at the defined frequency, to compensate for instability in the feed and maintain a stable balance between liquid drawn from the well and fluid inflow from the formation surrounding the well. Periodically, cycles are performed consisting of alternating; pumping, pumping off fluid, and accumulating fluid in the well. Pumping off is accomplished by modulating the frequency in a range of values corresponding to the parameters of maintaining a pump delivery rate with subsequent maintenance of the maximum frequency at which the pump does not resume delivery. In the inflow phase of fluid into the well, in the current cycle they modulate the frequency of the supply voltage of the electric pump in the frequency range corresponding to the change during fluid inflow parameters of pump in when delivery is stopped and resumed. During the inflow of fluid, the intake pressure of the pump reaches the defined value, and they resume delivery of the, fluid by pump, After that the cycle is repeated, and when in the current cycle the frequency of resuming the delivery does not exceed the defined frequency, the pump is switched into stationary mode. This differs from the present invention because, in the case of pump starvation, when it is brought to the defined frequency of the stationary mode during the defined time intervals of resuming and stopping of pump delivery, the additional frequency modulation for resuming fluid delivery is performed. Additional modulation is performed before pumping is resumed, which is performed at the additional frequency with a defined deviation from the frequency achieved before additional modulation of the pump's starvation frequency. After that it is necessary to continue bringing the pump to defined frequency of stationary mode with defined process rate of stabilization of the well.

In this method, modulating the frequency is performed for bringing the pump to a defined stationary frequency.

There is a known method of well exploitation using an electric submersible pump with a variable frequency drive (as discussed in Russian patent no. RF 2421605), which is used to stabilize wells equipped with an electric submersible pump (ESP) after a workover which implies changing the frequency of the electric motor supply voltage depending on the watercut of the well fluid.

However in this method the frequency of the supply voltage is changed only when the well is in pumpdown mode.

A method is for pumping low-flow rate wells using an electric pump with a variable frequency drive and device (Patent RU 2119578), based on periodic repeating cycles, including starting the pump with an increasing supply voltage frequency, operating the pump at the defined frequency, and after reaching a defined pressure in the tubing string at that frequency, the supply voltage frequency is reduced until the pump stops delivering fluid. Subsequently, a maximum frequency is maintained that ensures inflow from the surrounding formation and the pump does not resume delivery. After reaching defined pressure at the pump intake due to the inflow, the cycle is repeated and pump delivery is resumed by increasing its frequency.

The known method has the following disadvantages:

Sophisticated structures are needed to implement the method, namely, using additional downhole equipment such as temperature and pressure measuring systems installed under the downhole motor, which increases the cost of the method and prevents its application in areas of high temperature formation fluid (i.e., above 90° C.), due to the downhole electronics failing.

Thus the method is suitable only for low production wells.

Additionally, the pump shut off time is determined solely on the power and bench test characteristics of the pump, which causes significant errors, because testing is performed on fluid characteristics that do not match the fluid characteristics in each individual well.

SUMMARY OF THE INVENTION

The task of the declared method and device is assurance of the ability to operate both in low production wells and in wells with high inflow, i.e. in high production wells. Simplification of the device due to absence of submersible sensors. Increased lifespan of the pumping unit because it can run with higher capacity equipment as the declared method of work supports modes significantly exceeding limit parameters.

The said tasks is addressed by the fact that the method of exploitation of wells by pumping unit with variable frequency drive comprises periodic repetition of the cycles including pumpdown, search of frequency when delivery stops and accumulation and to ensure pumpdown of such amount of fluid from the well which is equal to its inflow it is necessary to choose pumping unit with high capacity in comparison with inflow of fluid from formation into well and during performance of cycles it is necessary to correct the ratio of pumpdown-accumulation time depending on the results of the work in the previous cycles until the ratio pumpdown-accumulation time stops to change and the time when delivery stops is determined based on the equation of the values of the current torque on the shaft of downhole motor and check torque on the which is pre-calculated based stepwise drop of torque on the shaft of the engine in the point when the delivery stops during decrease of the frequency of supply voltage.

The device for implementation of the method contains pumping unit consisting of placed in the tubing string electric submersible pump and downhole motor suspended on the tubing string, the downhole motor by conductive cable is linked with frequency converter on the surface and control device. The device also contains matching transformer, frequency, current, torque, power measurement unit, communication unit, indication and control unit. The conductive cable is linked with the first input-output of matching transformer, the second input-output of matching transformer is linked with input-output of frequency converter, the second input-output of frequency converter is linked with power supply, the third input-output of the frequency converter is linked with the first input-output of the frequency, current, torque, power measurement unit, the second input-output of this unit is linked with the first input-output of communication unit, the third input-output of the frequency, current, torque, power measurement unit is linked with the first input-output of controller, the second input-output of the controller is linked with indication and control unit. All signals received by units located on the surface are transmitted via conductive cable directly from the shaft of the downhole motor.

BRIEF DESCRIPTION OF THE DRAWINGS

The invention is explained by drawing where.

DETAILED DESCRIPTION OF THE PREFERRED EMBODIMENTS

Figure 1:
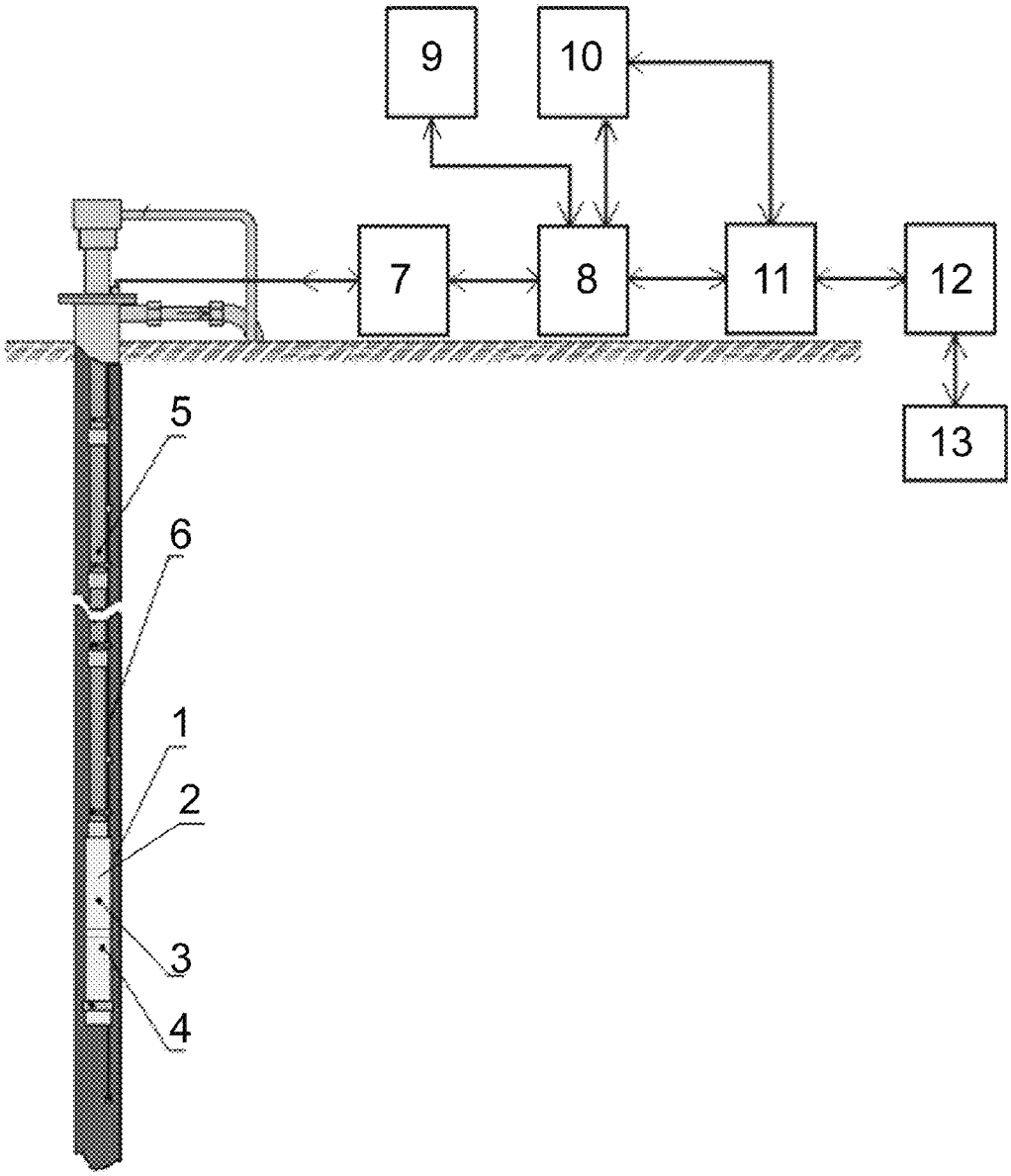
FIG. 1 is a schematic illustration of pumping unit with variable frequency drive which is used for exploitation of a well.

The device contains pumping unit 2 placed in the production casing string 1 consisting of an electric submersible pump 3 and a downhole motor 4 suspended from the downhole pipe string 5 by conducting cable 6, which is linked to devices located on the surface, namely a first linkage between the conducting cable 6 and the input-output of the matching transformer 7. A second linkage connects the input-output of the matching transformer 7 with input-output of the frequency converter 8. A third linkage connects the second input-output of the frequency converter 8 with a power supply 9. A fourth linkage connects the third input-output of the frequency converter 8 to the first input-output of the frequency-current-torque-power measurement unit 10. A fifth linkage connects the second input-output of the frequency-current-torque-power measurement unit 10 with the communication unit 11. A sixth linkage connects the second input-output of the communication unit with the fourth input-output of the frequency converter 8. A seventh linkage connects the third input-output of the communication unit 11 with the first input-output of the controller 12. An eighth linkage connects the second input-output of the controller 12 with the indication and control unit 13. Characteristics used for implementation of the methods are frequency on a shaft of the downhole motor 4, with current and torque setpoints MK1 and MK2:

MK1 is torque generated by downhole motor in the point where fluid delivery stops.

MK2 is a torque exceeding MK1 by 3-10%.

Implementation of the Method and Device

The device operates as follows.

Pumping unit 2 using conductive cable 6 via matching transformer 7 is connected with frequency converter 8 to which power is supplied from power unit 9. Frequency converter 8 converts commercial frequency voltage 50 Hz into the downhole motor voltage with variable frequency in the range from 0 to 300 Hz. The frequency range of pumping unit 2 with electric submersible motor 4 and electric submersible pump 3 practically ranges from 30 to 70 Hz.

Converter frequency 8 is provided with frequency, current, torque, power measurement unit 10 and measures output frequency of drive, current of downhole motor 4, torque, power supplied to downhole motor 4. All parameters are computed in real time with period of around 200 millisecond and are stored in digital format in the memory with frequency, torque measurement unit 10. Frequency converter 8 is provided with communication unit 11 which provides access for all devices to all parameters of frequency converter 8 and via which control commands are supplied by frequency converter 8.

Controller 12 provided with indication and control unit 13 continuously reads required parameters (frequency, current, voltage, power, torque, etc.) and transmit commands in accordance with control algorithm.

When exploitation of the well starts to measure the torque at which the delivery stops the pump unit is accelerated to the frequency at which the fluid delivery resumes. Then frequency is gradually reduced and the engine torque is continuously controlled. Usually, in case of gradual reduction of the frequency the torque on the engine shaft is gradually reduced. When the point when delivery stops is reached (idle run) the torque drops stepwise which is clear on the graphic screen of the controller (See FIG. 3). This torque value (in percent) is chosen as MK1 setpoint. The second setpoint MK2 is set 3-10% above the first one.

The method of exploitation of well by pumping unit with variable-frequency drive comprises periodic repetition of cycles including pumpdown, search of frequency for stopping delivery and accumulation to ensure the extraction of such amount of fluid from well which is equal to its inflow it is necessary to choose pumping unit with higher capacity in comparison with the well inflow from formation and during performance of cycles the pumpdown-accumulation ratio is corrected depending on the results of the previous cycle until the pumpdown-accumulation cycle stops changing and the moment when delivery stops is determined based on the equation of the values of current torque on the shaft of the downhole motor 4 and test torque which is preliminarily determined based on steplike drop of torque on the shaft of downhole motor 4 in the point when delivery stops when frequency of supply voltage decreases.

Figure 2:
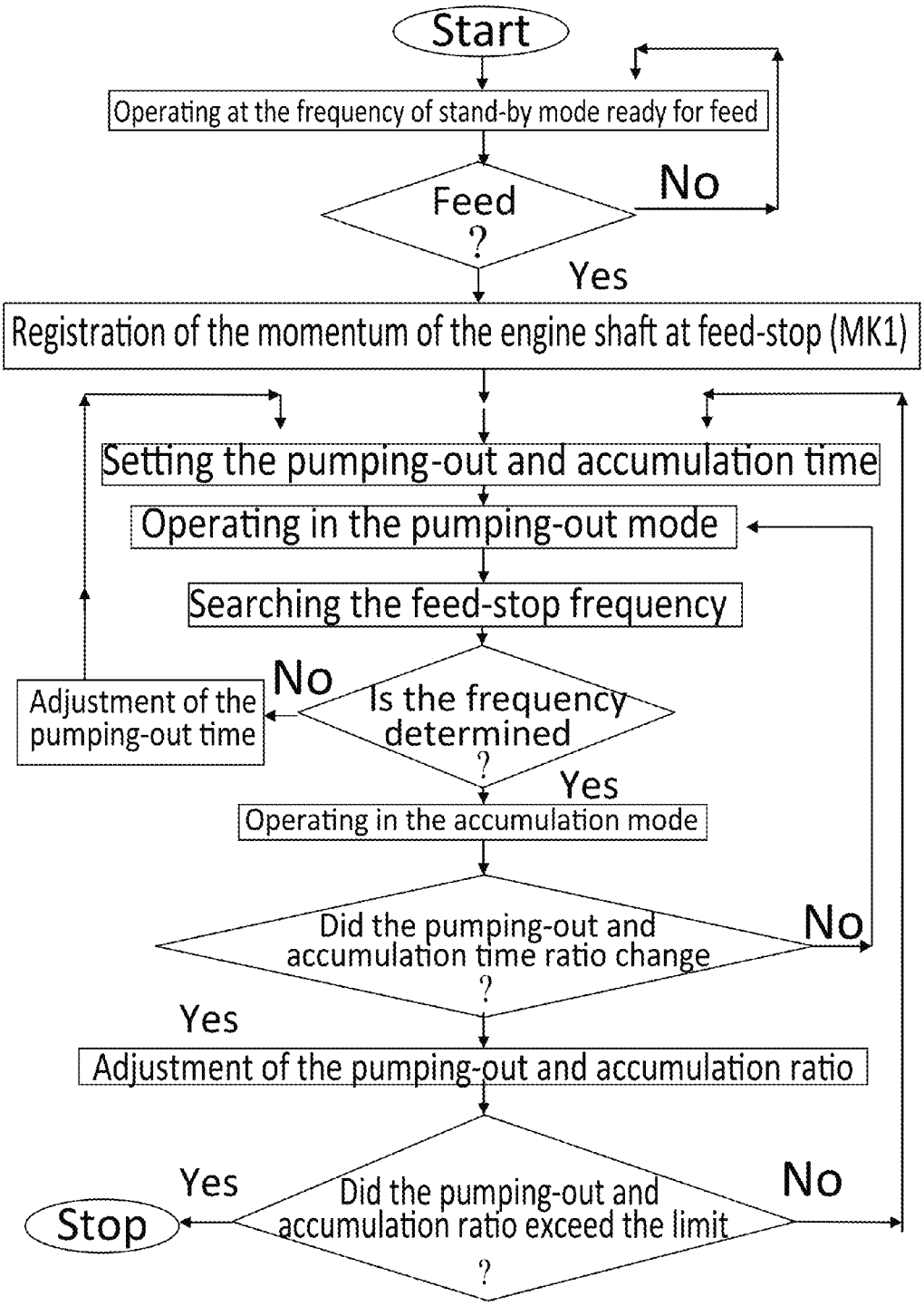
FIG. 2 is a diagram of the operating algorithm of the unit.

The operation of the device and implementation of the method is in accordance with flow-chart provided on FIG. 2.

After startup of the unit (start) it is operated at the frequency of delivery (delivery means delivery of fluid). When delivery starts the controller 12 receives signal from electric motor 4 frequency, current, torque, power measurement unit 10 and torque on the shaft of downhole motor 4 when delivery stops is measured. This value is also displayed on the indication and control unit 13. The delivery is stopped by gradual reduction of the frequency of supply voltage, the signal from controller 12 is transmitted via communication unit 11, frequency converter 8 to downhole motor 4. The rate of change of frequency is continuously compared with the rate of change of torque on the shaft of downhole motor 4. When fluid is delivered the rate of change of frequency and torque are proportional while when the point is achieved at which delivery stops the value of torque on the shaft of downhole motor 4 drops in stepwise manner because no energy is spent to lift the fluid (See FIG. 3 that provides charts of stabilized cyclic mode). Motor shaft torque (in %) is assumed as setpoint (MK1).

Depending on the performance of the unit and expected inflow the pumpdown and accumulation time is defined using the following ratio:

$$\frac{\text{Expected inflow}}{\text{Performance of unit}} = \frac{\text{Pumpdown time}}{\text{Pumpdown time} + \text{accumulation time}}$$

The unit is run in pumpdown mode for defined time and then it is switched to the mode of searching for frequency at which delivery stops. The frequency is determined when the current shaft torque of the downhole motor 4 is equal to check torque MK1. If frequency is not determined the pumpdown time is increased and cycle is repeated. If frequency is determined the unit is switched to accumulation mode at this frequency and is run for defined time. In each cycle it is necessary to check whether the pumpdown time and accumulation time ratio changes. If this ratio does not change it means that well runs in the stabilized cycling mode when inflow of fluid into well is equal to its extraction (the pumpdown-accumulation time ratio with constant pumpdown and accumulation time changes in the mode of searching for delivery stopping frequency because depending on the inflow the delivery stops at different frequencies, i.e. at different time).

If pumpdown-accumulation time ratio changes it is corrected. It is an automatic process using controller 12 that receives information from unit of measurement of frequency, current, torque, power 10 of the downhole motor 4. Controller 12 transmits control signals via communication unit 11 to frequency converter 8 which via matching transformer 7 transmits signals to conducting cable 6 to equalize the inflow of fluid from formation and its extraction. If the pumpdown-accumulation ratio exceeds the set limits, i.e. it cannot be adjusted do to various reasons the well is shut and then re-started.

The invention allows for optimization of production of oil by pumpdowns of such amount of fluid which is equal to its inflow in the well. The method proposes to use pumping unit with higher capacity in comparison with well fluid inflow. The method is based on adjustment of the amount of pumped down fluid from well by periodic repletion of cycles and each of such cycles includes three modes:

The first mode is an operation at the frequency at which fluid is pumped down;

The second mode is the mode of searching for frequency for stopping the delivery;

The third mode is operation at the frequency at which delivery is stopped.

Figure 3:
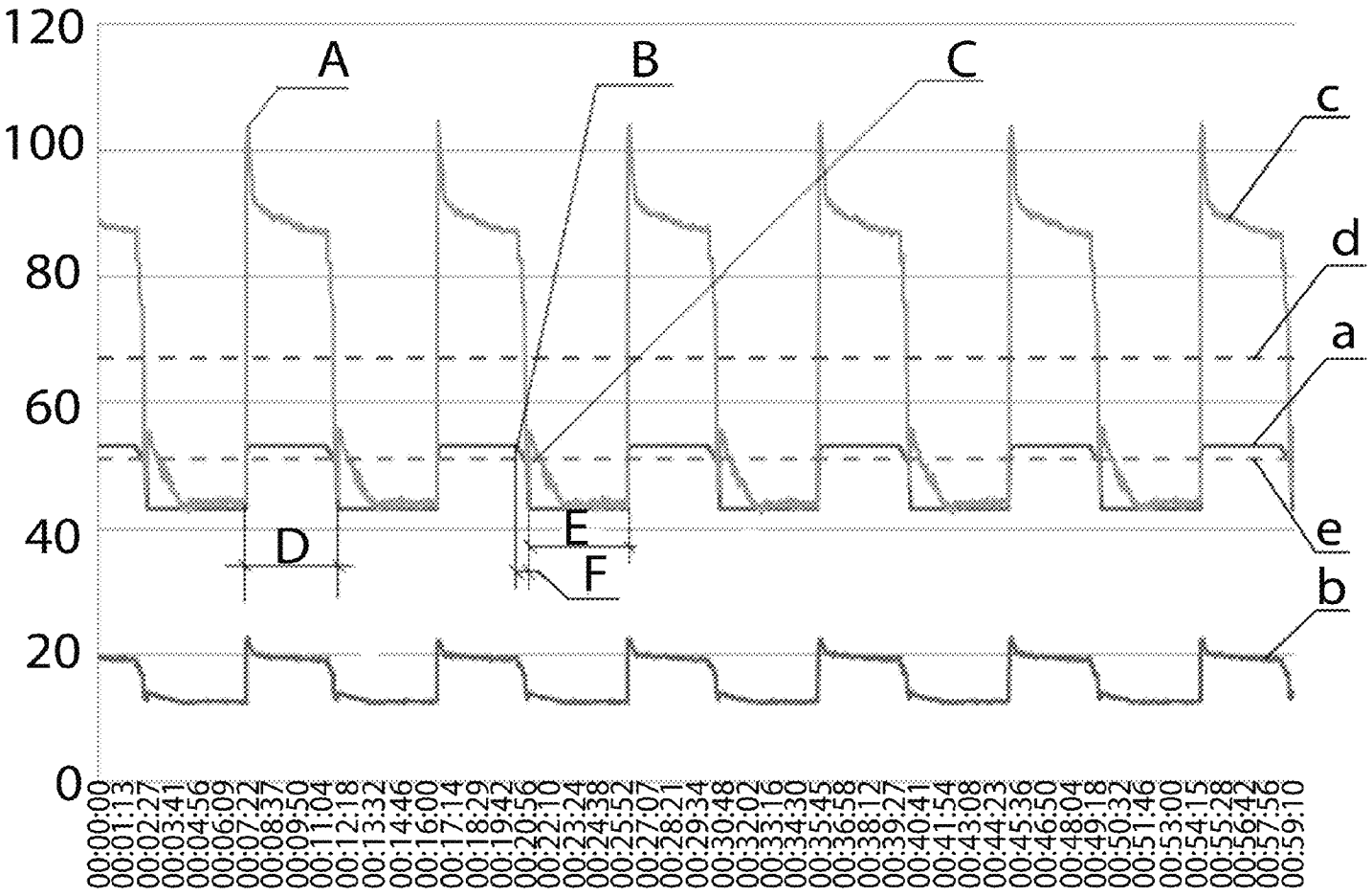
FIG. 3 is an operation chart in cycles pumpdown-accumulation of stabilized cyclic mode, wherein A—is start of transition to pumpdown mode; B—is start of searching of delivery stopping frequency; C—is start of accumulation; D—is pumpdown time; E—is accumulation time; F—is search of frequency when delivery stops; a—is frequency; b—is current; c—is torque; d—is MK 2; e—is MK 1.

The modes are illustrated in FIG. 3.

The method is implemented as follows:

After the first startup wait for the delivery and measure check shaft torque of downhole motor at which the delivery stops when motor speed drops. The check torque is assumed as a setpoint for switching the modes. Depending on the inflow based on the results of the previous cycles the pumpdown and accumulation time ratio is corrected until this ratio stops changing i.e. until the well is stabilized in the cyclic mode when inflow from formation is equal to the amount of extracted fluid.

COMMERCIAL APPLICABILITY

The device is designed using available and commercially produced accessories.

The main difference from the prototype in terms of the method is the fact that in the proposed method the cyclic mode is main mode both during well stabilization and during current exploitation.

The method and device are designed for all wells including low production wells. In high production wells the method allows for application of submersible pumps with knowingly higher capacity in comparison with well productivity which helps to extend the lifespan of the unit because the it is run with loads which are significantly lower than limit loads.

The device does not require any downhole sensors which simplifies this device. In the proposed device all signals are transmitted to units located on the surface via conductive cable directly from downhole motor shaft.

The torque at which delivery stops is determined based on the actual fluid properties and actual specifications of the pumping unit by measurement of the rate of change of the rotating torque of downhole motor shaft. It is known that when frequency drops when delivery stops, i.e. when engine runs in idle mode the rotating torque of the shaft drops stepwise which allows for determination of the torque when delivery stops taking into account all actual conditions, i.e. the properties of fluid and specifications of the unit.

This method of well exploitation using the proposed device allows for usage of pumping unit with higher capacity in comparison with well inflow for delivery of the best results of in increasing the production of oil. This simplifies sizing of the pumping unit and extends time between overhauls during operation because the unit in this case runs in derated operating modes which ensures.

Thus the above demonstrates delivery of technical result

PARTS LIST

Production casing string 1
Pumping unit 2
Electrical submersible pump 3
Downhole motor 4
Downhole pipe string 5
Conductive cable 6
Matching transformer 7
frequency converter 8
Power supply 9
Frequency, current, torque, power measurement unit 10
Communication unit 11
Controller 12
Indication and control unit 13

What is claimed is:

1. A device for exploiting a well using a pumping unit having a variable-frequency drive and periodically repeating pumpdown cycle searching for a stopping delivery frequency, and an accumulation cycle, the device comprising:

a pumping unit disposed in a production casing string, the pumping unit comprising an electrical submersible pump and a downhole motor suspended in the production casing string;

the downhole motor connected by a conductive cable to a frequency converter and further in communication with a controller, the frequency converter and the controller being disposed on a surface outside the well;

a matching transformer in communication with the frequency converter;

a frequency-current-torque-power measurement unit in communication with the frequency converter;

a communication unit in communication with the frequency converter and the frequency-current-torque-power measurement unit;

an indication and control unit in communication with the controller;

wherein the conductive cable is linked to the matching transformer, the matching transformer is linked to the frequency converter, the frequency converter is linked to a power supply and the frequency-current-torque-power measurement unit, the frequency-current-torque-power measurement unit is linked to the communication unit, the communication unit is linked to the frequency converter, the communication unit is also linked to the controller, and the controller is linked to an indication and control unit and wherein all signals transmitted to the surface from the conductive cable are transmitted directly from a shaft of the downhole motor.

* * * * *